US007115197B2

(12) United States Patent
Reed et al.

(10) Patent No.: US 7,115,197 B2
(45) Date of Patent: Oct. 3, 2006

(54) COATING PROCESS

(76) Inventors: Allan Reed, 18 Balmoral Avenue, Castlepark, Ellon, Aberdeenshire, AB41 9PW (GB); John Matthew Boettger, 21 Lyndon Rd., Fayetteville, NY (US) 13066; Thomas J. Garosshen, 128 Martin Ter., Glastonbury, CT (US) 06033

( * ) Notice: Subject to any disclaimer, the term of this patent is extended or adjusted under 35 U.S.C. 154(b) by 238 days.

(21) Appl. No.: 10/443,481

(22) Filed: May 22, 2003

(65) Prior Publication Data

US 2004/0026259 A1 Feb. 12, 2004

(30) Foreign Application Priority Data

May 24, 2002 (GB) ..... 0211965.9

(51) Int. Cl.
*C25D 5/02* (2006.01)
*C25D 3/56* (2006.01)

(52) U.S. Cl. ..... 205/118; 205/122; 205/238; 205/244

(58) Field of Classification Search ..... 205/238, 205/244–246, 118, 122
See application file for complete search history.

(56) References Cited

U.S. PATENT DOCUMENTS 2,086,841 A * 7/1937 Bagley et al. ..... 205/137
3,922,396 A * 11/1975 Speirs et al. ..... 148/529
4,104,133 A 8/1978 Brannan et al.
4,439,283 A * 3/1984 Verberne et al. ..... 205/176
4,772,362 A * 9/1988 Martin et al. ..... 205/246
5,200,057 A * 4/1993 Canaris ..... 205/313
5,283,131 A 2/1994 Mori et al.
5,314,321 A * 5/1994 Yamamoto et al. ..... 418/178
5,417,840 A * 5/1995 Block et al. ..... 205/246
5,435,898 A * 7/1995 Commander et al. ..... 205/245
5,947,710 A 9/1999 Cooper et al.
6,071,631 A 6/2000 Takahata
6,083,376 A * 7/2000 Akram et al. ..... 205/143
6,167,711 B1 1/2001 Slattery et al.
6,881,026 B1 * 4/2005 Lifson et al. ..... 415/72

FOREIGN PATENT DOCUMENTS

EP 0 100 777 2/1984

* cited by examiner

*Primary Examiner*—Nam Nguyen
*Assistant Examiner*—Luan V. Van
(74) *Attorney, Agent, or Firm*—Wall Marjama & Biliaski LLP

(57) ABSTRACT

This invention relates to a process for electroplating a selected surface area of a component with a crushable zinc alloy, the method comprising utilizing a relatively low current density in an alkaline solution during the electroplating process to provide a crushable coating of said zinc alloy on said selected surface area.

16 Claims, 2 Drawing Sheets

COATING PROCESS

FIELD OF THE INVENTION

This invention relates to a coating process, and in particular to an electroplating process for use in applying a zinc alloy coating to a component, and also to components coated in accordance with such a process.

BACKGROUND OF THE INVENTION

Recently, there have been significant advances in the design of screw machines, such as described in U.S. Pat. Nos. 5,947,710 and 6,167,711, the disclosures of which are incorporated herein by reference. Based on these and other advances, "zero clearance" compressor screws have been produced, one of the main advantages of such compressors being that the screws may operate effectively and efficiently in the presence of minimal or no sealing and lubricating oil between the screw rotor profiles. However, it has proved difficult to achieve the associated high tolerances in the screw rotor profiles using techniques which are commercially viable.

It is known to coat metal components to provide selected surface characteristics, one of the most commonly used coating processes being electroplating. The majority of techniques used for electroplating are carried out under acidic conditions where the coatings formed are continuous and generally robust and thus provide effective anti-corrosion protection. By adding so-called "brighteners", the formed coatings also have a high quality or "bright" finish. Examples of such techniques are described in European Patent Application No. 0100777 and U.S. Pat. Nos. 4,104,133, 6,071,631 and 5,283,131.

U.S. Pat. No. 5,435,898 relates to an alkaline electroplating process in which it is a specific object of this patent to form a 'pit-free' alloy deposit, obtained by using a quaternary ammonium polymer additive as a "brightener".

It is among the objectives of at least one embodiment of the present invention to provide an economical method of coating a compressor component to provide the high tolerances necessary for successful operation of a zero clearance compressor screw.

SUMMARY OF THE INVENTION

According to the present invention there is provided a process for electroplating a selected surface area of a component with a crushable zinc alloy, the method comprising utilising a relatively low current density in an alkaline solution during the electroplating process to provide a crushable coating of said zinc alloy on said selected surface area.

It has been found that when electroplating a selected surface area of a component with a zinc alloy using conventional techniques, the plating process tends to proceed more rapidly at the edges of the area, producing a greater thickness of material at the edges of the plated area; typically the thickness at the edge is two or three times the thickness of the material spaced from the edge. In many situations this may not present a difficulty. However, where the thickness of the applied coating is critical, as in a zero tolerance or oil free compressor screw, the resulting differences in coating thickness across an area are likely to be unacceptably large. In the present invention, the use of lower current densities, particularly at the cathode (1–2 A/dm$^2$), has the disadvantage that the plating process proceeds relatively slowly.

However, a significant advantageous effect is that the zinc alloy is deposited more consistently across the selected area, such that a substantially constant thickness of applied material is achieved.

The provision of a crushable zinc alloy coating is particularly useful for use in components where zero or minimal clearances are being sought, and particularly in meshing parts, such as screw compressors. Where parts mesh and the coating thickness, on one or both of the parts, initially exceeds the intended clearance between the parts, the coating may be crushed down or compacted to provide the zero clearance along a crush line on initial meshing of the parts, which may take place on a pairing stand or rig. The ability to crush down the coating may also allow a degree of relaxation of the tolerances applied to the base component, thus allowing the component to be machined or otherwise formed more economically.

The process may comprise masking areas of the component such that the coating is only applied to unmasked areas of the component.

Preferably the zinc alloy is a zinc-nickel alloy, though alloys of zinc and one or more other transition metals may be utilised, including zinc-iron and zinc-cobalt alloys.

The alkaline solution may have a pH>11 and preferably of about 12. The alkalinity of the solution may be achieved by the presence of a suitable material, such as sodium hydroxide. Most preferably, the sodium hydroxide is present in relatively high concentration relative to the zinc and may be present in a range of 3–4M. It has been found that the use of an alkaline process facilitates the formation of a crushable coating.

Preferably, the component is agitated in the plating solution. Where the component is a screw compressor component, the component may be mounted vertically in the solution and rotated about its axis, the flutes in the component tending to cause the solution to move up and down the flutes relative to the component. Surprisingly, such agitation is far more effective in achieving satisfactory plating using the method of the invention, and the conventional method of agitating the solution while the component remains stationary provides significantly poorer results.

Preferably, the anode is in the form of a cage or other structure which substantially surrounds the component in the electroplating solution. This large area anode allows use of relatively low anode current densities (less than 1 A/dm$^2$), without the difficulties that would normally result using conventional plating techniques, that is the provision of an inconsistent coating. Most preferably, the cage is oriented vertically, and the component is positioned vertically within the cage, with an upper portion of the cage extending beyond the upper end of the component, and with the lower end of the component extending beyond a lower portion of the cage, typically by a distance of around 5 cm (2 inches). This arrangement provides a more consistent coating thickness across the height of the component. If the component is located within the ends of the cage, or the ends of the component are coterminous with the ends of the cage, the coating tends to be relatively thin towards the upper end of the component and relatively thick towards the lower end of the component.

The formed crushable coating may be about 1050 μm thick or preferably about 20–30 μm thick. The crushable coating may also have a highly contoured nodular surface comprising a plurality of small rounded columnar protuberances with a height variation of about ±10 μm or more preferably about ±5 μm. Selected regions of the crushable coating may be compacted to form a substantially even or planar surface.

The invention also relates to components coated using the process of the invention, and to machines and devices incorporating such components, notably oil free screw compressors.

BRIEF DESCRIPTION OF THE DRAWINGS

These and other aspects of the present invention will now be described, by way of example, with reference to the accompanying drawings, in which.

DETAILED DESCRIPTION OF THE DRAWINGS

Figure 1:
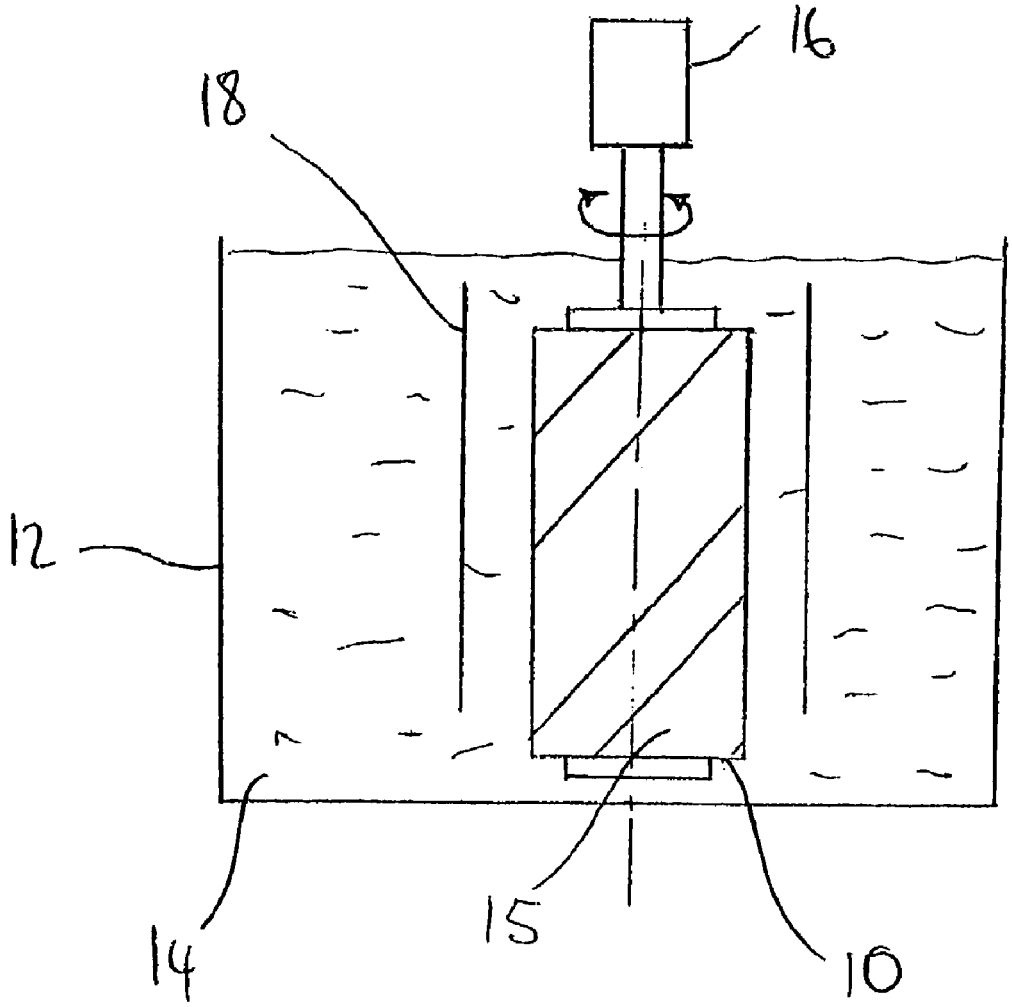
FIG. 1 illustrates, somewhat schematically, an electroplating process in accordance with a preferred embodiment of the present invention.

FIG. 1 illustrates an electroplating process in accordance with a preferred embodiment of the present invention, for use in applying a coating of zinc-nickel alloy to selected areas of a component, in this example a screw 10 of an oil free zero tolerance compressor, such as described in U.S. Pat. No. 6,167,771.

The screw 10 is suspended in a tank 12 filled with an alkaline zinc-nickel solution 14, as will be described in more detail below. The screw 10 serves as the cathode such that the zinc and nickel are deposited on the screw 10. The alloy is intended to be applied only to selected areas of the screw 10, and the other areas are masked 15, using techniques familiar to those of skill in the art.

A particular technique to mask part of the screw 10 involves initially applying masking tape to areas which require coating. A lacquer coating, such as VINOMIT (Trade Mark) is then applied to the unmasked areas. Once the lacquer has dried, the masking tape may be removed and the required areas exposed for coating. The lacquer coating may be removed following plating by dipping the screw 10 in an organic solvent.

The screw 10 is suspended from an oscillating device 16, which oscillates the screw 10 in the solution 14 around the longitudinal axis of the screw 10 at 30–40 oscillations per minute.

The screw 10 is located coaxially within a cylindrical stainless steel cage 18 which serves as the anode. It will be noted that the upper end of the screw 10 is spaced downwardly from the upper end of the cage 18 (by approximately 5 cm), and also that the lower end of the screw extends by a similar amount from the lower end of the cage 18.

The operating conditions for the process are set out below:

| | Preferred | Range |
|---|---|---|
| Zinc Metal concentration | 9.5 g/l | 8 to 11.5 g/l |
| Nickel Metal concentration | 1.2 g/l | 1.0–1.5 g/l |
| Ratio Zn:Ni | 8:1 | 7.5:1–8.5:1 |
| Temperature | 24° C. | 23–25° C. |
| Cathode current density | 1.5 A/dm$^2$ | 1–2 A/dm$^2$ |
| Anode current density | 0.75 A/dm$^2$ | 0.25–2A/dm$^2$ |
| Voltage | <3 volts | <2–4 volts |
| pH | 12 | >11 |

The preferred process is based on a modified form of the Udylite (Trade Mark) Zincrolyte (Trade Mark) NCZ Ni 308 process.

By running the process for approximately one hour, a layer of zinc-nickel alloy containing 5 to 7% by weight nickel, and 20–30 μm thick, is obtained on the unmasked areas, the 10 μm variation being acceptable for the preferred application. The alloy tends to grow on the mask free areas of the screw surface in a columnar structure.

Figure 2:
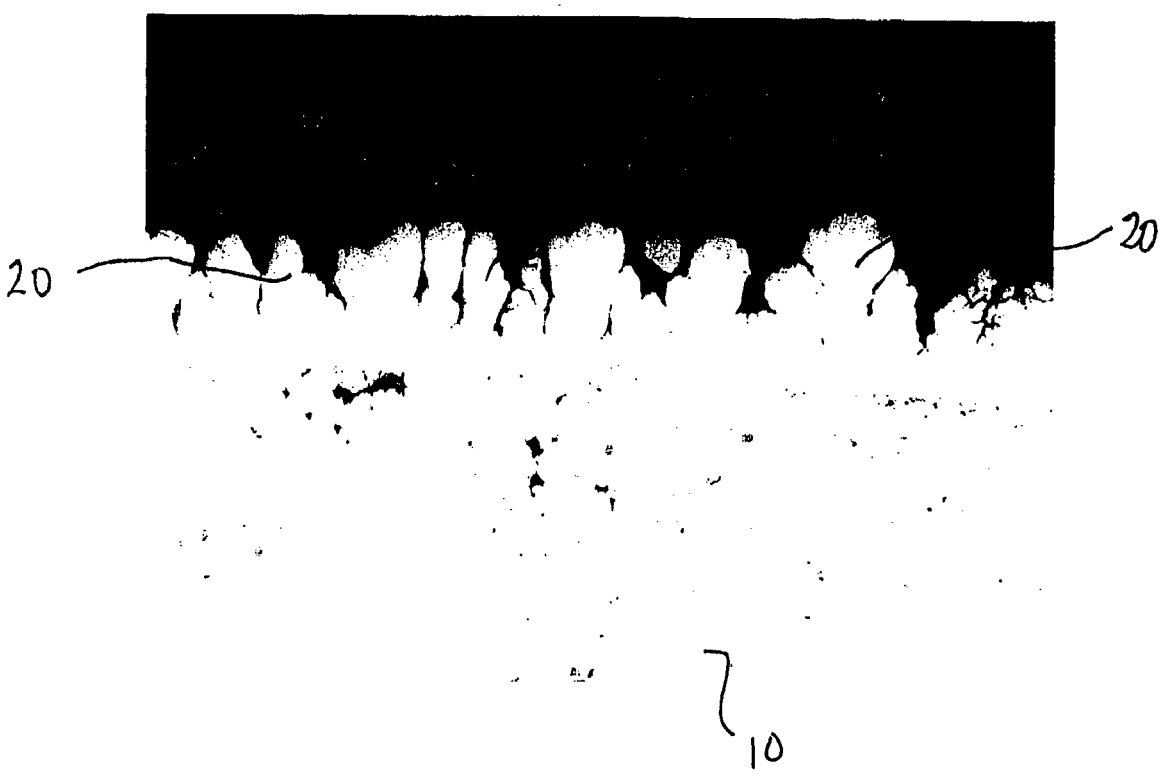
FIG. 2 is a sectional view of an article coated according to the present invention.

FIG. 2 is a representation of the formed crushable coating 20. FIG. 2 clearly shows that the crushable coating 20 has a nodular surface which is highly contoured. As indicated below, the crushable coating may be compressed to form a substantially even coating.

The plated screw 10 is then mounted in an appropriate rig or pairing stand together with the parts with which the screw 10 is in tended to intermesh. By rotating the parts the appropriate elements of the parts will come into contact and create crush lines between the "zero tolerance" surfaces, and to ensure that the appropriate small gaps are provided between other meshing areas. Assuming that the components intermesh as intended, the components may then be assembled in the compressor housing.

It will be apparent to those of skill in the art that the above-described process is effective in providing electroplating of selected surface areas of a component within restricted tolerances, and also provides an effective means for creating crush lines or other areas of zero tolerance between meshing parts.

The invention claimed is:

1. A process for electroplating a selected surface area of a component with a crushable zinc alloy, the method comprising utilising a relatively low current density in an alkaline solution during the electroplating process to provide a crushable coating of said zinc alloy on said selected surface area wherein the component is a screw compressor component having a main axis and defining flutes, the component being mounted vertically in the solution and rotated about said axis at a sufficient speed such that the flutes in the component cause the solution to move up and down the flutes relative to the component.

2. The process of claim 1, comprising providing a cathode and wherein the current density at the cathode is in the range of 1–2 A/dm$^2$.

3. The process of claim 1, further comprising meshing the coated component with another part to crush down the coating to provide an area of zero clearance between the component and the part along a crush line.

4. The process of claim 1, further comprising masking areas of the component such that the coating is only applied to unmasked areas of the component.

5. The process of claim 1, wherein the zinc alloy is an alloy of zinc and at least one other transition metal.

6. The process of claim 5, wherein the zinc alloy is a zinc-nickel alloy.

7. The process of claim 5, wherein the zinc alloy is a zinc-iron alloy.

8. The process of claim 5, wherein the zinc alloy is a zinc-cobalt alloy.

9. The process of claim 1, wherein the coating process takes place in an alkaline solution of pH>11.

10. The process of claim 9, wherein the alkalinity of the solution is achieved by the presence of sodium hydroxide.

11. The process of claim 9, wherein the alkaline solution has a concentration of 3–4M.

12. The process of claim 1, wherein the component is agitated in a plating solution.

13. The process of claim 1, comprising providing an anode in the form of a structure which substantially surrounds the component in the solution.

14. The process of claim 13, wherein the anode is in the form of a cage.

15. The process of claim 14, comprising providing an anode in the form of a cage which is oriented vertically, and the component is positioned vertically within the cage, with an upper portion of the cage extending beyond the upper end of the component, and with the lower end of the component extending beyond a lower portion of the cage.

16. The process of claim 13, comprising providing an anode and wherein the anode current density is less than 1 $A/dm^2$.

* * * * *